US008662821B2

(12) United States Patent
Chevrette

(10) Patent No.: US 8,662,821 B2
(45) Date of Patent: Mar. 4, 2014

(54) REMOVABLE STEAM INLET ASSEMBLY FOR STEAM TURBINE

(75) Inventor: Richard Jon Chevrette, Troy, NY (US)

(73) Assignee: General Electric Company, Schenectady, NY (US)

( * ) Notice: Subject to any disclaimer, the term of this patent is extended or adjusted under 35 U.S.C. 154(b) by 709 days.

(21) Appl. No.: 12/980,614

(22) Filed: Dec. 29, 2010

(65) Prior Publication Data

US 2012/0171010 A1 Jul. 5, 2012

(51) Int. Cl.
*F01D 25/30* (2006.01)

(52) U.S. Cl.
USPC ..... 415/1; 415/213.1

(58) Field of Classification Search
USPC ..... 415/213.1, 214.1, 108, 1
See application file for complete search history.

(56) References Cited

U.S. PATENT DOCUMENTS

| | | | | |
|---|---|---|---|---|
| 4,433,830 | A * | 2/1984 | Campbell | 254/264 |
| 4,500,096 | A | 2/1985 | Tuttle et al. | |
| 5,411,306 | A * | 5/1995 | Campbell et al. | 294/81.4 |
| 6,964,554 | B2 | 11/2005 | Groenendaal et al. | |
| 7,331,754 | B2 | 2/2008 | O'Clair et al. | |
| 2004/0213653 | A1 * | 10/2004 | Tomko et al. | 414/458 |
| 2007/0081892 | A1 | 4/2007 | Sharrow | |

* cited by examiner

*Primary Examiner* — Dwayne J White
(74) *Attorney, Agent, or Firm* — Ernest G. Cusick; Frank A. Landgraff

(57) ABSTRACT

A removable steam inlet assembly and lifting fixture for a steam turbine are provided to facilitate lifting of the upper exhaust hood of the steam turbine. The removable steam inlet assembly is detached from the steam inlet of the turbine inner casing for the lift and mounted to the upper exhaust hood with a lifting fixture. Detaching and removal of the steam inlet assembly substantially lowers the clearance height for the lift, allowing lower turbine building height with significant cost savings.

20 Claims, 7 Drawing Sheets

REMOVABLE STEAM INLET ASSEMBLY FOR STEAM TURBINE

BACKGROUND OF THE INVENTION

The invention relates generally to steam turbines and more specifically to maintenance operations requiring access to components within an exhaust hood of the steam turbine.

The outer shell of a steam turbine low-pressure section is generally called the exhaust hood. The primary function of an exhaust hood is to divert the steam from the last stage bucket of an inner shell to the condenser with minimal pressure loss. Usually the lower half of the exhaust hood supports an inner casing of the steam turbine and also acts as a supporting structure for the rotor. The upper exhaust hood is usually a cover to guide the steam to the lower half of the hood. The hood for large double-flow low-pressure steam turbines is of substantial dimensions and weight and usually is assembled only in the field. In many steam turbines, the inner case of the steam turbine, for example a double flow/down exhaust unit has an encompassing exhaust hood split vertically and extending along opposite sides and ends of the turbine. This large, box-like structure houses the entire low-pressure section of the turbine. The exhaust steam outlet from the turbine is generally conically-shaped and the steam exhaust is redirected from a generally axial extending flow direction to a flow direction 90 degrees relative to the axial flow direction. This 90-degree flow direction may be in any plane, downwardly, upwardly or transversely. Thus the exhaust hoods for steam turbines constitute a large rectilinear structure at the exit end of the conical section for turning and diffusing the steam flow at right angles.

The lower half of the exhaust hood, split horizontally from the upper half, directs the exhaust flow of steam to a condenser usually located generally beneath the exhaust hood. The lower exhaust hood typically supports the inner casing of the turbine and the associated steam path parts such as diaphragms and the like. The lower exhaust hood is further loaded by an external pressure gradient between atmospheric pressure on the outside and near-vacuum conditions internally. The lower exhaust hood shell is generally of fabricated construction with carbon-steel plates. Typical sidewalls for the lower exhaust hood are flat and vertically oriented. To provide resistance to the inward deflection of the sidewalls under vacuum loading, the lower exhaust hood traditionally has included internal transverse and longitudinal plates and struts. These internal transverse and longitudinal plates and struts form a web, generally underneath the turbine casing and extending to the sidewalls.

FIG. 1 illustrates typical arrangements of a prior art low-pressure double-flow steam turbine 5 with an exhaust hood 10. The exhaust hood 10 includes an upper exhaust hood 15 and a lower exhaust hood 20, mating at a horizontal joint 22. A turbine inner casing 25 is supported at multiple supporting pads (not shown) on the lower exhaust hood 20. To distribute the load from these pads to an external foundation (not shown) for the low-pressure turbine, various supporting structures are present in the form of transverse plates 40. These transverse plates 40 avoid the suction effect of the sidewalls 45 and end walls 50 and they distribute the load applied on the hood due to loads on inner casing 25. The lower exhaust hood 20 further provides a support location for shaft seals (not shown) and end bearings 75 for the turbine rotor 70. The lower exhaust hood 20 may include a framework that rests on the external foundation (not shown). The sidewalls 45 and end walls 50 may be constructed of flat metal plates, joined at seams by welding or other known joining methods.

A steam inlet 30 may penetrate a top of the upper exhaust hood 15 and include a seal 55 with the upper exhaust hood. The steam inlet 30 admits steam into steam chest 35 of the turbine inner casing 25. The steam inlet 30 may be fabricated as an integral part of the inner turbine casing 25 or may be fabricated separately and welded to the inner turbine casing. Steam from steam inlet is directed by series of fixed stator vanes 60 to rotating blades 65 for driving a turbine rotor 70. Bearing housings 75 for the turbine rotor 70 are provided at axial ends of the exhaust hood 10.

When access is required to the inside of the exhaust hood 10 or inside the turbine inner casing 25, the upper exhaust hood 15 may be removed. Such access may be required for preventive maintenance, repair maintenance or modification. Due to the significant size and weight of the upper exhaust hood, a heavy-duty overhead crane is required to perform the lifting. The upper exhaust hood must be lifted high enough 88 to clear the top 31 of the highest fix object remaining attached to the inner casing 25, which is the steam inlet 30. Studies, performed to analyze construction cost of a gas turbine power plant, suggest that about $300,000 to $350,000 per meter of facility height, or up to about $10,000 per inch of facility height, is required to provide concrete block walls for such a facility in order to clear the top height.

Accordingly, it would be desirable to provide turbine equipment and methods for limiting power plant height and hence facility costs.

BRIEF DESCRIPTION OF THE INVENTION

Briefly in accordance with one aspect of the present invention, a method is provided for limiting clearance height necessary to lift an upper exhaust hood of the exhaust hood of a steam turbine with an inner turbine casing, where the upper exhaust hood includes limiting height interference components within the upper exhaust hood. The method includes making a height limiting interference component within the upper exhaust hood detachable from the steam turbine and then attaching the limiting height interference component to the upper exhaust hood. The limiting height interference component is then lifted while attached to the upper exhaust hood.

Another aspect of the present invention provides an arrangement for removing an upper exhaust hood section for a steam turbine. The arrangement includes a steam turbine, an exhaust hood for the steam turbine including an upper exhaust hood and lower exhaust hood, and a turbine inner casing disposed within the exhaust hood. An external steam piping supplies steam to the steam turbine. A removable steam inlet assembly is disposed between the external steam piping and the turbine inner casing, the steam inlet assembly extending through a sealed penetration of the upper exhaust hood. The removable steam inlet assembly, when so disposed, comprises a limiting height clearance component for removal of the upper exhaust hood.

The arrangement also includes a lifting fixture attachable to the removable steam inlet assembly and to a section of the upper exhaust hood through which the removable steam inlet assembly extends. A lifting device such as an overhead crane is disposed at a location permitting lifting of the upper exhaust hood.

According to a further aspect of the present invention, a steam turbine is provided. The steam turbine exhausts to an exhaust hood, which includes an upper exhaust hood and lower exhaust hood joined at a horizontal flange. The steam turbine includes a turbine inner casing disposed within the exhaust hood. External steam piping provides steam to the steam turbine. A removable steam inlet assembly is disposed between the external steam piping and the turbine inner casing. The steam inlet assembly extends through a sealed penetration of the upper exhaust hood. A lifting fixture is attachable to the removable steam inlet assembly and to a section of the upper exhaust hood through which the removable steam inlet assembly extends, allowing the upper exhaust hood to support the removable steam inlet assembly during a lift of the upper exhaust hood.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

To lift an upper exhaust hood free and away from a lower exhaust hood and inner turbine casing, the upper exhaust hood must vertically clear the highest component fixed to the inner casing or remaining within the exhaust hood space. The following embodiments of the present invention have many advantages, including limiting facility height and thereby allowing a substantial cost reduction for a power plant facility by providing a steam turbine inlet assembly that is easily removable from the turbine inner casing and which may be lifted jointly with the upper exhaust hood. Such a cost savings may amount to about $10,000 per inch of power plant height. The lifting arrangement clears the highest component at a significant height differential compared to prior art arrangements for fixed steam inlet assemblies, potentially saving the power plant operator significant facility costs by allowing a lower wall height.

Figure 1:
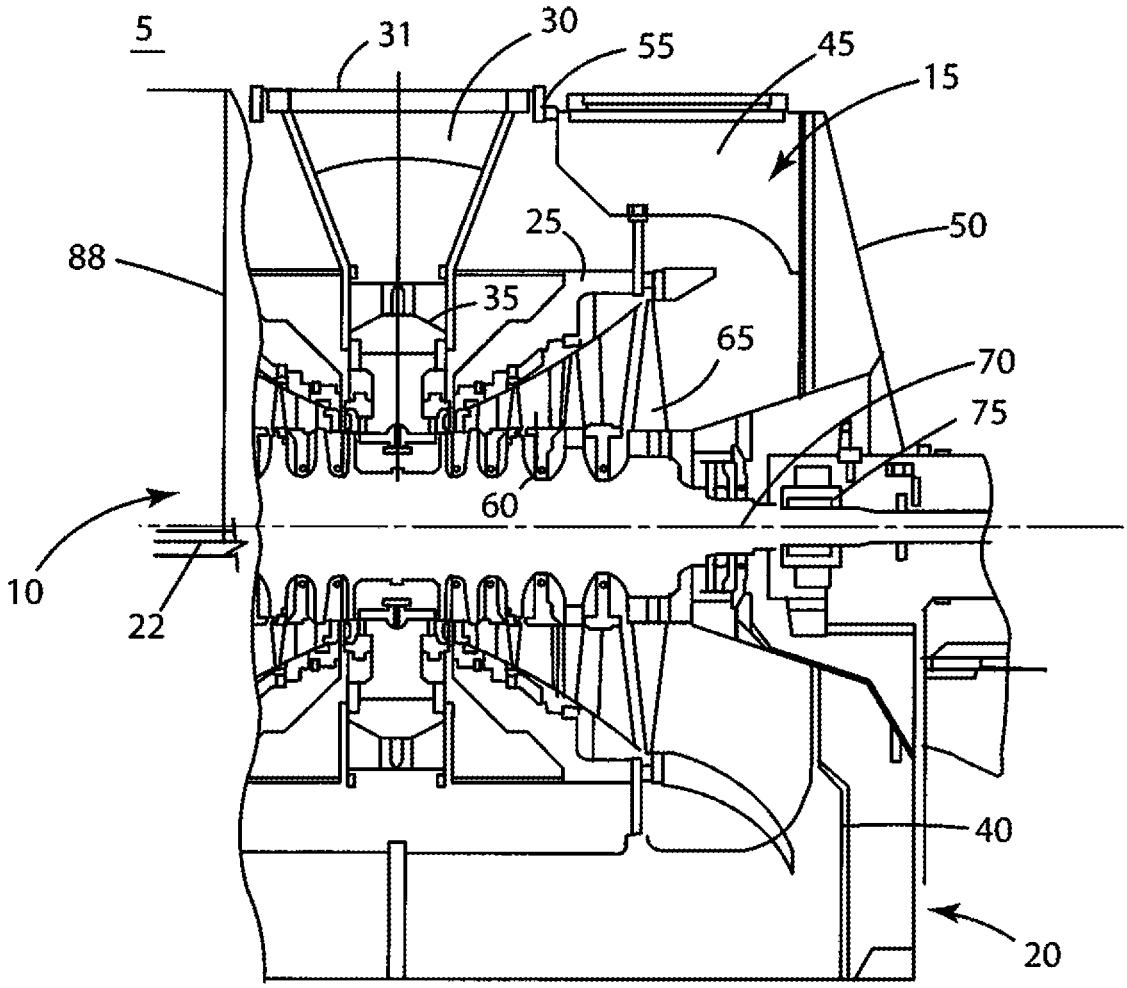
Figure 1 (Prior Art)
FIG. 1 illustrates a typical prior art steam turbine with a unitary turbine inner casing and fixed inlet steam assembly.

Again referring to prior art of FIG. 1, the steam inlet 30 is rigidly fixed to the turbine inner casing by welding or initial fabrication of the turbine inner casing. The steam inlet cannot be easily removed from the turbine inner casing 25. Further, the top 31 of the steam inlet 30 forms the highest point that the upper exhaust hood must clear to be lifted free and away from the lower exhaust hood and turbine inner casing. A height of the steam inlet 30 may be about 5 feet. Therefore, to remove the upper exhaust hood, it must be lifted above the top 31 of steam inlet 30, which is the top clearance height for such a lift.

Figure 2:
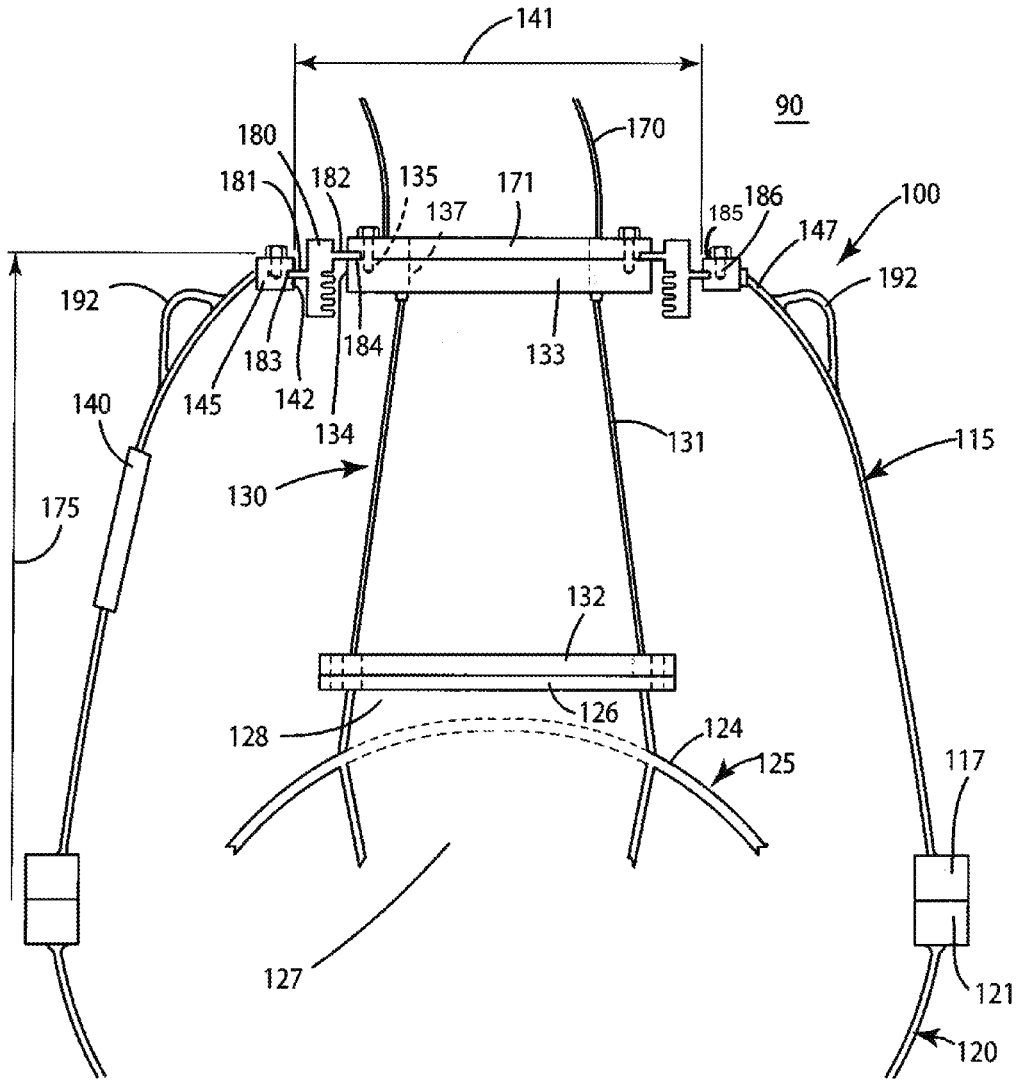
FIG. 2 illustrates a section view of an embodiment for an arrangement of a removable steam inlet assembly within an upper exhaust hood of a steam turbine.

According to an embodiment of the present invention, an arrangement 90 for a removable steam inlet assembly 130 for a steam turbine 100 is illustrated in FIG. 2. The body 131 of the removable steam inlet assembly 130 may be formed funnel-shaped, adjusting in area from an outer radial end to an inner radial end with respect to a steam entrance 128 to the turbine inner casing 125. A bottom flange 132 with a central steam opening 136 of the removable steam inlet assembly is configured to and attaches to the steam inlet flange 126 extending upward from turbine inner casing 125. Steam inlet flange 126 includes a steam opening 128 above a steam inlet chest 127 within the turbine inner casing 125. The bottom flange 132 of the removable steam inlet assembly may bolt to steam inlet flange 126 on the upper surface 124 of the turbine inner casing 125. Access to the bolted flanges 126, 132 may be provided through manway covers 140 disposed at various locations on the upper exhaust hood 115, allowing personnel access for bolting or unbolting the bottom flange 132 of steam inlet assembly 130 from the turbine inner casing 125 when the steam turbine 100 is shutdown.

The body 131 of the steam inlet assembly 130 extends outward through the upper exhaust hood 115 and above the steam inlet chest 127 of the turbine inner casing 125. The outer radial end of the steam inlet assembly body 111 may include a top flange 133 with a central steam opening 137. A plurality of boltholes 135 may be arranged around the outer periphery 134 of the top flange 133 of the removable steam inlet assembly. The plurality of boltholes 135 may provide for bolted attachment to inlet steam piping 170 from a steam source such as a high-pressure turbine, intermediate-pressure turbine or other heat source (not shown).

The top flange 133 of the removable steam inlet 130 may be positioned at an elevation roughly equivalent to a top height 175 of the upper exhaust hood 115. A penetration 141 in the top surface of the upper exhaust hood 115 may be provided to accommodate the top flange 133 of the steam inlet assembly 130 for connection with steam piping inlet flange 171 of inlet steam piping 170. The penetration 141 in the top surface 147 of the upper exhaust hood 115 may include a peripheral flange 145. A bellows element 180 may be disposed between an inner surface 142 of the penetration 141 in the top portion 142 of the upper exhaust hood 115 and an outer surface 134 of the top flange 133 of the steam inlet assembly 130. The bellows element 180 may include an outer seal surface 181 that engages horizontally with a recess 183 in the penetration peripheral flange 145 of the upper exhaust hood 115, forming an outer seal for the steam inlet assembly 130 at the upper exhaust hood 115. The bellows element 180 may further include an inner seal surface 182 that engages horizontally with a recess 184 in the top flange 133 of the steam inlet assembly 130, which together with steam piping inlet flange 171 seals between bellows element and top flange 133. The penetration peripheral flange 145 may also include bolts/bolt holes 186 on an outer radial surface 185 that will tighten the outer seal 181 in the recess 183 of the peripheral flange 145 and which will also facilitate lifting of the steam inlet assembly 130 as will be described in greater detail. The top flange 133 of the steam inlet assembly 130 may include bolt/bolt holes 135 for engagement with that will tighten inner seal 182 in recess 184 and which will also facilitate lifting of the steam inlet assembly as will be described in greater detail. The outer seal surface 181 and inner seal surface 182 maintain the integrity of the exhaust hood 110 around the steam inlet assembly 130. The bellows element 180 accommodates the flexing of the upper exhaust hood 115 due to temperature and pressure variations within and outside the upper exhaust hood 115.

Horizontal joint flange 117 joins the upper exhaust hood 115 to horizontal joint flange 121 of the lower exhaust hood 120.

Figure 3:
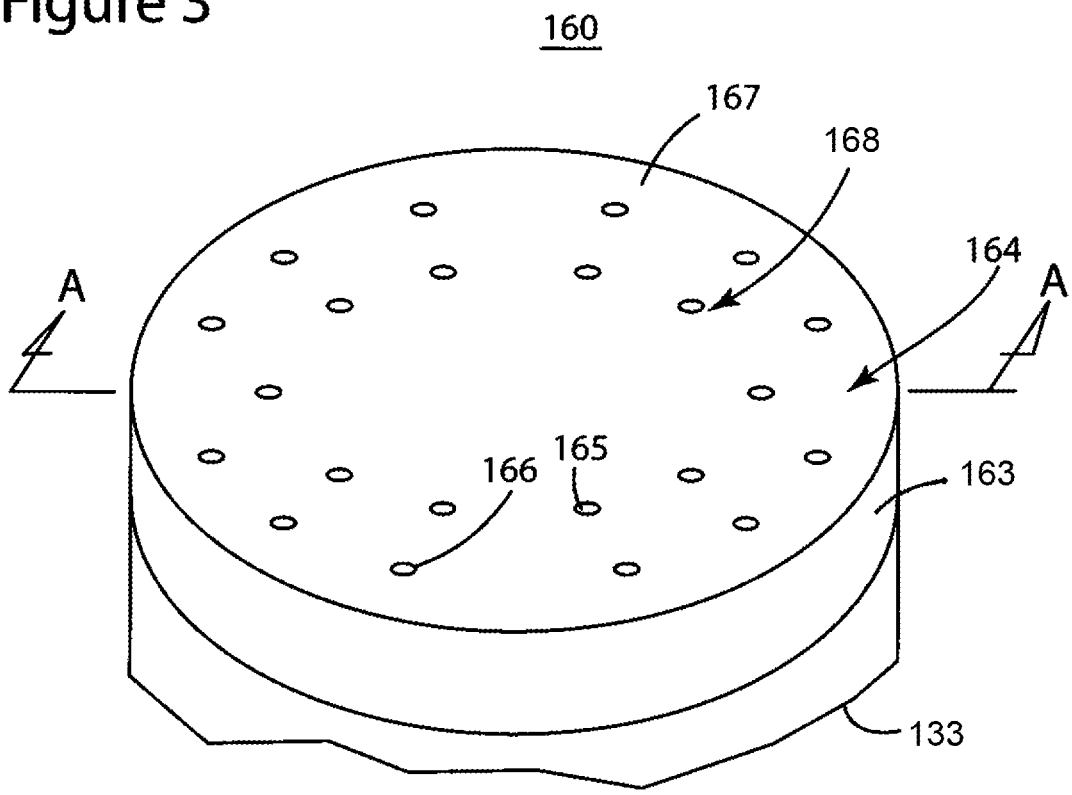
FIG. 3 illustrates an expanded isometric view of a lifting fixture for supporting the removable steam inlet assembly by the upper exhaust hood during a lift of the upper exhaust hood.

FIG. 3 illustrates an isometric view of an embodiment of the inventive lifting fixture 160. The lifting fixture 160 shows top surface 167 of main plate 168. Inner bolthole array 165 is used to fasten to top flange 133 FIG. 4) of steam inlet assembly 130. Outer bolthole array 166 is used to fasten to peripheral flange 145 (FIG. 4) of upper exhaust hood.

Figure 4:
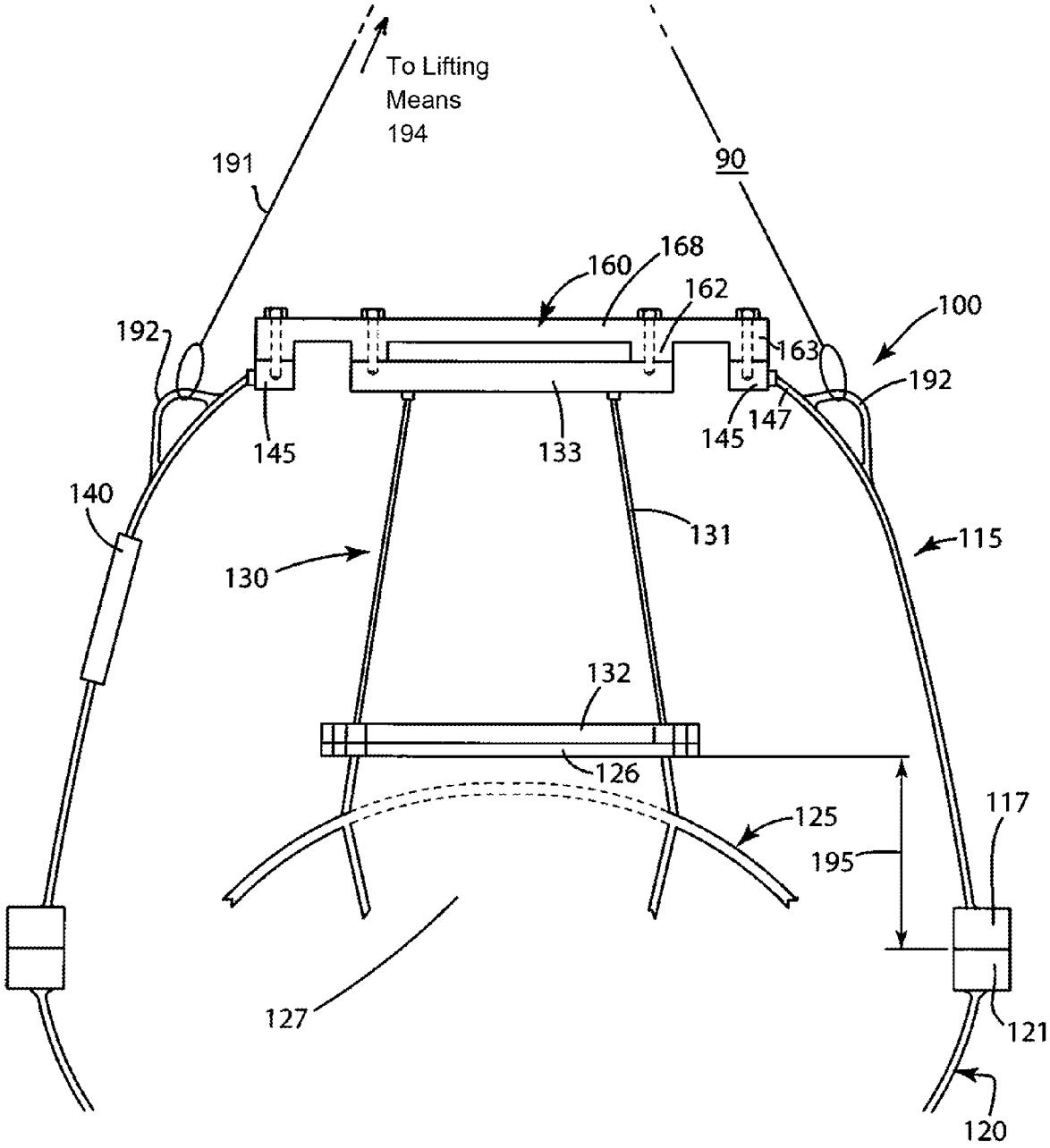
FIG. 4 illustrates a section view for an embodiment of an arrangement utilizing the lifting fixture for attaching the removable steam inlet assembly to the upper exhaust hood of a steam turbine during a lift of the exhaust hood.

FIG. 4 illustrates the arrangement 90 for the removable inlet steam assembly 130 with a lifting fixture 160. The lifting fixture 160 holds the removable steam inlet assembly 130 to the upper exhaust hood 115 when the upper exhaust hood is lifted. The lifting fixture may include a main plate 168 disposed above the penetration 141 (FIG. 2) for the removable steam inlet assembly 130 on the upper exhaust hood 115. The main plate 168 may include an inner standoff 162 and an outer standoff 163. The inner standoff extends the lifting fixture 160 to the top flange 133 for the removable steam inlet assembly 130. The outer standoff 163 extends the lifting fixture 160 to the peripheral flange 145. An inner bolt pattern 161 on the lifting fixture 160 extends through the inner standoff 162 into complimentary threaded holes 135 on outer surface of top flange 133. These bolt holes 135 (FIG. 2) are also used during normal operation for attaching the external inlet steam piping 170 to top flange 133 of steam inlet assembly 130. An outer bolting pattern 164 extends through outer standoff 163 and is complimentary to the plurality of bolts/boltholes 186 holes (FIG. 2) of the peripheral flange 145 around the top penetration 141 on the upper exhaust hood 115.

After the steam inlet piping 170 with steam piping inlet flange 171 (FIG. 2) is removed, the lifting fixture 160 may be bolted to both the upper exhaust hood 115 and to the top flange 133 of the steam inlet assembly 130, thereby attaching the steam inlet assembly to the upper exhaust hood.

Figure 5:
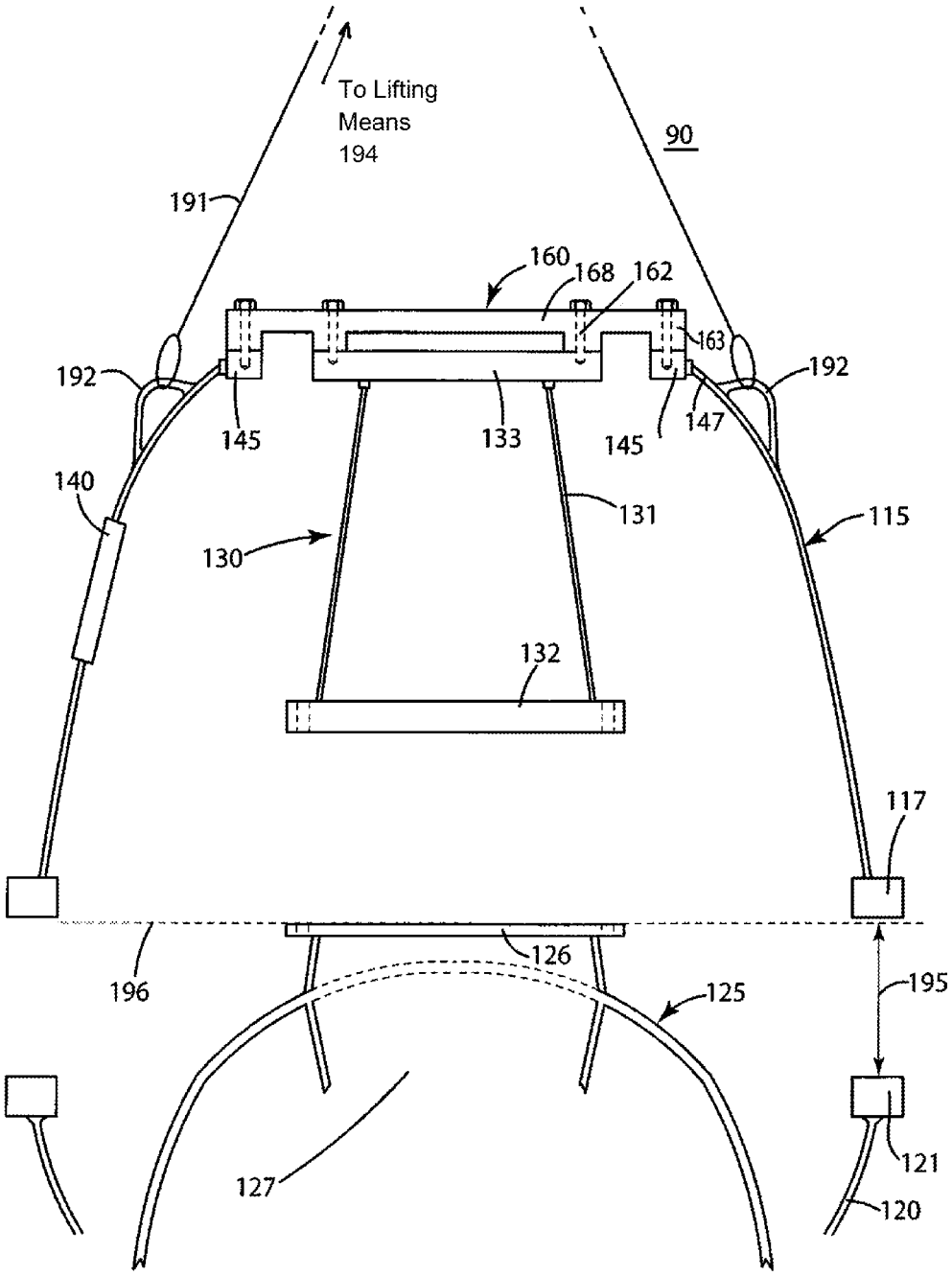
FIG. 5 illustrates a section view of a lift of an upper exhaust hood of a steam turbine with a removable steam inlet assembly using the lifting fixture where the upper exhaust hood has cleared a limiting clearance height.
Figure 6:
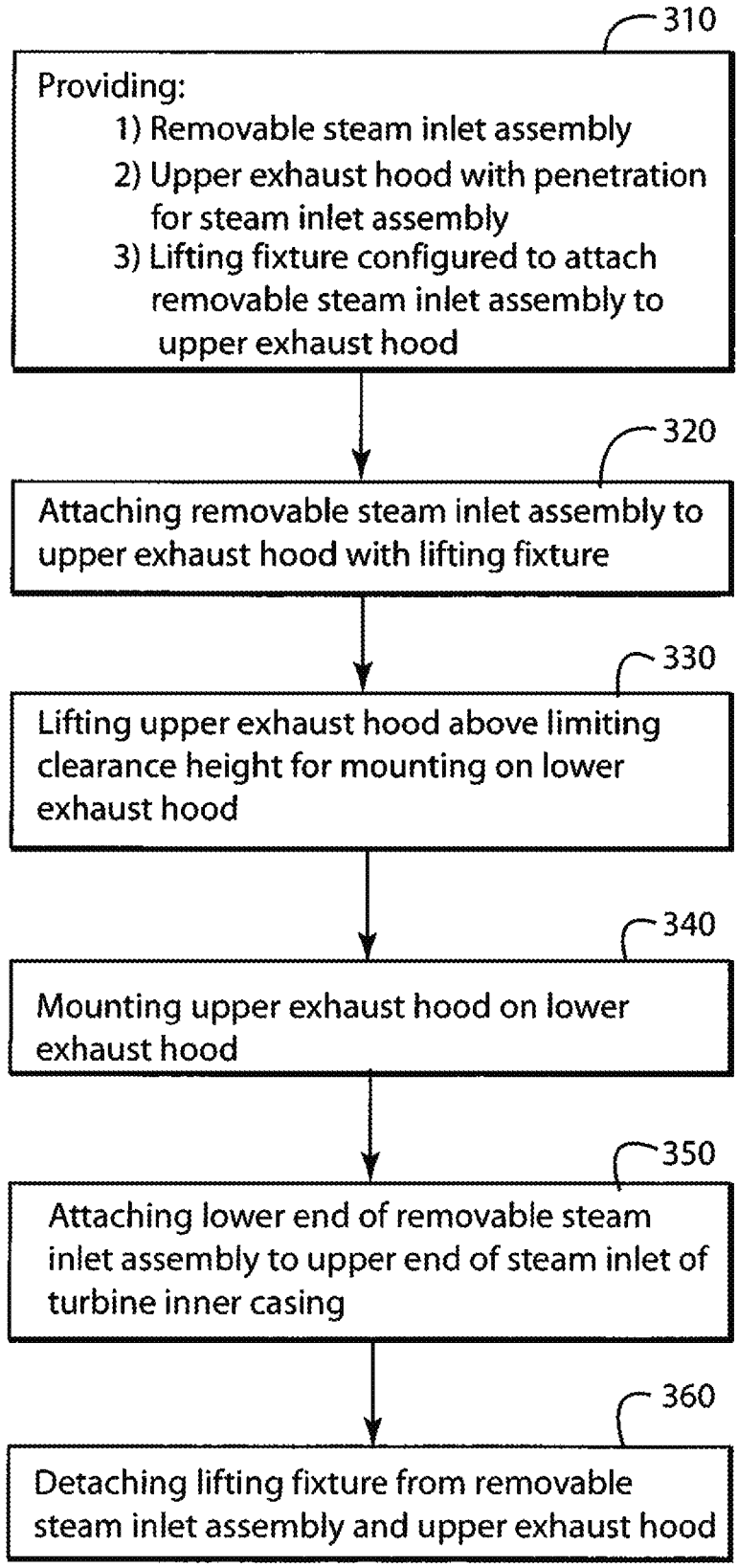
FIG. 6 illustrates a flow chart for an inventive method for limiting clearance height needed for installation of the upper exhaust hood of a steam turbine that includes limiting height interference components within the upper exhaust hood.

FIG. 5 illustrates a combined lift of the upper exhaust hood together with the removable steam inlet assembly employing the lifting fixture. The lift may employ any suitable means for lifting, such as an overhead crane (not shown), attached by lifting lines 191 to lifting lugs 192 disposed at various locations on the upper exhaust hood 115. With the steam inlet assembly 130 unbolted from the steam inlet flange 126 of the turbine inner casing 125, the steam inlet assembly may be supported by the upper exhaust hood 115 through lifting fixture 160 during a lift of the upper exhaust hood 115. The steam inlet assembly 130 will lift when the upper exhaust hood 115 is lifted. It will not be necessary to clear the upper exhaust hood 115 over the top of the steam inlet 30 (FIG. 1), as was previously required when the steam inlet was fixed permanently to the turbine inner casing 115. In the inventive arrangement, the lift 195 need only raise the horizontal flange of the upper exhaust hood over a limiting height component 196, which may be the steam inlet flange 126 to the turbine inner casing 125. The upper exhaust hood 115 may then be moved to an appropriate landing site away from the lower exhaust hood 120 of the steam turbine 100.

Consequently, in a lift with the removable steam inlet assembly 130, the required lift of the upper exhaust hood 115 is reduced by the height of the removable steam inlet assembly. In an exemplary case, the height of the removable steam inlet assembly 130 is approximately 59 inches. A reduction of the height necessary for lifting the exhaust hood by 59 inches may allow the building height to be reduced by the same 59 inches. The savings on building construction of lowering the building height by 59 inches may be approximated by Equation 1:

$$\text{Cost Savings}=59\text{ inches (height reduction)}\times\$10{,}000\text{ (per inch of wall height)}=\$590{,}000 \qquad \text{Equation 1.}$$

A method is also provided for installation and removal of an upper exhaust hood on a steam turbine with a removable steam inlet assembly. For initial installation and subsequent installations of the upper exhaust hood 115 on the lower exhaust hood 120, the removable steam inlet assembly 130 is bolted to a steam inlet assembly lifting fixture 160. The steam inlet assembly lifting fixture 160 is in turn bolted to the upper exhaust hood steam inlet flange 145.

A suitable means for lifting 194, such as an overhead crane, lifts the upper exhaust hood 115 with the removable steam inlet assembly 130. The crane positions the upper exhaust hood 115 on the lower exhaust hood 120 and at the same time locates a lower end flange 132 of the removable steam inlet assembly 130 on the top flange 126 of the steam inlet 127 of the turbine inner casing 125. The upper exhaust hood 115 may be mounted to the lower exhaust hood 120 along the horizontal flanges 117, 121. Access to the inner space of the upper exhaust hood 115 is provided through man-way covers 140. The bottom flange 132 on the removable steam inlet assembly 130 is bolted to the top flange 126 of the turbine steam inlet 125. The lifting fixture 160 may then be removed from the top flange 133 of the removable steam inlet assembly 130 and the peripheral flange 145 of the upper exhaust hood flange 145. The steam inlet piping 170 may then be attached to the top flange 133 of the removable steam inlet assembly 130.

During subsequent outages when upper half exhaust hood 115 removal is necessary, the inlet steam piping 170 is unbolted from the removable steam inlet assembly 130. The lifting fixture 160 is bolted to both the top flange 133 of the removable steam inlet assembly 130 and the bolting ring 145 of the upper exhaust hood 145. In this way, the upper exhaust hood 115 supports the removable steam inlet assembly 130. Access is provided to the inner space of the upper exhaust hood 115 via the man-way covers 140. The lower flange 132 on the removable steam inlet assembly 130 is unbolted from the top flange 126 of the steam inlet 127 of the turbine inner casing 125. An overhead crane may attach with lifting lines 191 to lifting lugs 192 on the upper exhaust hood 115. Both the upper exhaust hood 115 and the removable steam inlet assembly 130 are lifted simultaneously, clearing interferences until the upper exhaust hood can be moved away from the lower exhaust hood 120. For an exemplary embodiment, where the height for the permanently fixed steam inlet was previously about 59 inches, the lift with the removable steam inlet assembly 130 may be reduced by about that height.

Figure 7:
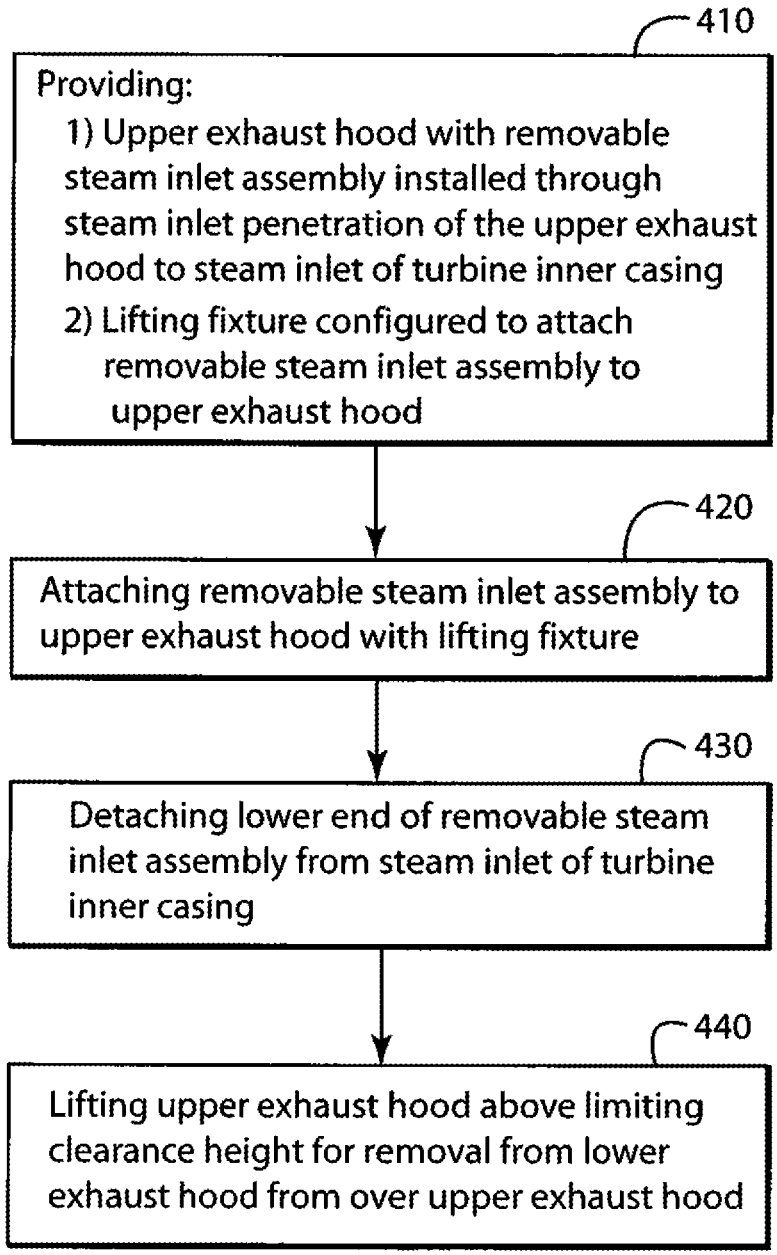
FIG. 7 illustrates a flow chart for an inventive method for limiting clearance height needed for removal of the upper exhaust hood of a steam turbine that includes limiting height interference components within the upper exhaust hood.

FIGS. 7 and 8 illustrate a flow chart for an inventive method for limiting clearance height needed for installation and removal of the upper exhaust hood casing of a steam turbine with complimentary upper and lower exhaust hoods that include limiting height interference components within the upper exhaust hood. The method includes making a limiting height interference component within the turbine exhaust hood detachable from the steam turbine and then lifting the limiting height interference component together with the upper exhaust hood.

FIG. 7 illustrates a flow chart of a method for an installation of the upper exhaust hood for a steam turbine with a removable steam inlet assembly onto the lower exhaust hood. Step 310 provides a removable steam inlet assembly, an upper exhaust hood with a penetration for the removable steam inlet assembly, and lifting fixture configured to attach the removable steam inlet assembly to the exhaust hood of a steam turbine. Step 320 attaches the removable steam inlet assembly to the upper exhaust hood using the lifting fixture. Step 330 lifts the upper exhaust hood above a clearance height for mounting on a lower exhaust hood. Step 340 mounts the upper exhaust hood on the lower exhaust hood, at the same time seating the lower end of the removable steam inlet assembly on the steam inlet to the turbine inner casing. Step 350 attaches the lower end of the removable steam inlet assembly to an upper end of the steam inlet to the turbine inner casing. Step 360 detaches the lifting fixture from the removable steam inlet assembly and the upper exhaust hood.

FIG. 8 illustrates a flowchart for removal of the upper exhaust hood for a steam turbine with a removable steam inlet assembly from the lower exhaust hood. Step 410 provides an upper exhaust hood with a removable steam inlet assembly installed through a steam inlet penetration of the upper exhaust hood to a steam inlet of the turbine inner casing and also provides a lifting fixture configured to attach the removable steam inlet assembly to the upper exhaust hood. Step 420 attaches the removable steam inlet assembly to the upper exhaust hood utilizing the lifting fixture. Step 430 detaches the lower end of the removable steam inlet assembly from the steam inlet to the turbine inner casing. Step 440 lifts the upper exhaust hood above the limiting clearance height for removal of the upper exhaust hood from over the lower exhaust hood.

While various embodiments are described herein, it will be appreciated from the specification that various combinations of elements, variations or improvements therein may be made, and are within the scope of the invention.

The invention claimed is:

1. A method for limiting clearance height necessary to lift an upper exhaust hood of the exhaust hood of a steam turbine with an inner turbine casing, wherein the upper exhaust hood includes limiting height interference components within the upper exhaust hood, the method comprising:

making a limiting height interference component within the upper exhaust hood detachable from the steam turbine;

attaching the limiting height interference component to the upper exhaust hood; and lifting the limiting height interference component with the upper exhaust hood.

2. The method of claim 1, the step of making a limiting height interference component within the upper exhaust hood detachable from the steam turbine further comprising:

providing a flanged joint between the limiting height interference component and the turbine inner casing.

3. The method of claim 2, wherein the limiting height interference component is a steam inlet assembly.

4. The method of claim 3, further comprising:

unbolting the flanged joint between the steam inlet assembly and the turbine inner casing.

5. The method of claim 1, the step of lifting the limiting height interference component together with the upper exhaust hood comprising:

providing a lifting fixture for attaching the limiting height interference component to the upper exhaust hood; and attaching the limiting height interference component to the upper exhaust hood with the lifting fixture.

6. The method of claim 5, wherein the limiting height interference component comprises a removable steam inlet assembly with an upper flanged joint and the step of attaching comprises attaching the lifting fixture between the upper flanged joint of the removable steam inlet assembly and a peripheral flange for a penetration of the upper exhaust hood.

7. The method of claim 6, the step of attaching further comprising bolting the lifting fixture to the upper flanged joint of the steam inlet assembly and to the peripheral flange for the penetration of the upper exhaust hood.

8. The method of claim 7, further comprising:

lifting the upper exhaust hood with lifting lines attached to means for lifting;

supporting the removable steam inlet assembly with the lifting fixture during lifting of the upper exhaust hood; and moving the upper exhaust hood to a landing site when the upper exhaust hood clears the next limiting height interference component.

9. An arrangement for removing an upper exhaust hood section for a steam turbine, the arrangement comprising:

a steam turbine;

an exhaust hood for the steam turbine, the exhaust hood including an upper exhaust hood and lower exhaust hood;

a turbine inner casing disposed within the exhaust hood;

an external steam piping supplying steam to the steam turbine;

a removable steam inlet assembly disposed between the external steam piping and the turbine inner casing, the steam inlet assembly extending through a sealed penetration of the upper exhaust hood, wherein the removable steam inlet assembly when so disposed, comprises a limiting height clearance component for removal of the upper exhaust hood;

a lifting fixture attachable to the removable steam inlet assembly and to a section of the upper exhaust hood through which the removable steam inlet assembly extends; and means for lifting disposed at a location permitting lifting of the upper exhaust hood.

10. The arrangement of claim 9, further comprising:

a steam inlet flange on the turbine inner casing;

a top steam flange on the removable steam inlet assembly, the top flange bolted to the external steam piping for steam turbine operation; and a bottom steam flange on the removable steam inlet assembly, the bottom flange bolted to the steam inlet flange on the turbine inner casing for steam turbine operation.

11. The arrangement of claim 10 wherein for lifting of the upper exhaust hood, the bottom steam flange of the removable steam inlet assembly is detached from the steam inlet flange of the turbine inner casing and the top steam flange of the removable steam inlet assembly is detached from the external steam piping.

12. The arrangement of claim 11, wherein for lifting of the upper exhaust hood, the lifting fixture is attached between removable steam inlet assembly and the upper exhaust hood.

13. The arrangement of claim 12, wherein the upper exhaust hood comprises a peripheral flange around the penetration for the removable steam assembly and for lifting of the upper exhaust hood, the lifting fixture attaches the top flange of the removable steam inlet assembly to the peripheral flange of the upper exhaust hood.

14. The arrangement of claim 13, wherein the means for lifting lifts the upper exhaust hood in a unitary lift with the removable steam inlet assembly attached to the peripheral flange of the upper exhaust hood, the limiting clearance height for lift is reduced.

15. A steam turbine comprising:

an exhaust hood for the steam turbine, the exhaust hood including an upper exhaust hood and lower exhaust hood joined at a horizontal flange;

a turbine inner casing disposed within the exhaust hood;

external steam piping providing steam to the steam turbine;

a removable steam inlet assembly disposed between the external steam piping and the turbine inner casing, the steam inlet assembly extending through a sealed penetration of the upper exhaust hood; and a lifting fixture attachable to the removable steam inlet assembly and to a section of the upper exhaust hood through which the removable steam inlet assembly extends, configured to support the removable steam inlet assembly during a lift of the upper exhaust hood.

16. The steam turbine according to claim 15, wherein the removable steam inlet assembly comprises:

a top flange configured to attach to the steam inlet piping;

a bottom flange configured to join with the turbine inner casing; and a funnel body directing steam between the top flange and the bottom flange.

17. The steam turbine according to claim 16, wherein the lifting fixture mounts above the upper exhaust hood and joins the top flange of the removable steam inlet assembly to a peripheral flange of the upper exhaust hood for lifting of the upper exhaust hood.

18. The steam turbine according to claim 17, wherein the lifting fixture comprises an inner standoff for attachment to the top flange of the removable steam inlet assembly and an outer standoff for attachment to the peripheral flange of the upper exhaust hood.

19. The steam turbine according to claim 18, wherein the peripheral flange of the upper exhaust hood supports the removable steam inlet assembly through the lifting fixture during a lift of upper exhaust hood.

20. The steam turbine according to claim 19, further including an enclosure building wherein a height of the enclosure building may be established according to a required lifting height of the upper exhaust hood.

* * * * *